US008371444B1

(12) United States Patent
Huang

(10) Patent No.: US 8,371,444 B1
(45) Date of Patent: Feb. 12, 2013

(54) TOOL POSITIONING PAD

(76) Inventor: Kevin Huang, Taichung (TW)

( * ) Notice: Subject to any disclaimer, the term of this patent is extended or adjusted under 35 U.S.C. 154(b) by 0 days.

(21) Appl. No.: 13/208,351

(22) Filed: Aug. 12, 2011

(51) Int. Cl.
*B65D 85/28* (2006.01)

(52) U.S. Cl. ..... 206/373; 506/374; 506/377; 506/378; 211/69; 211/70.6

(58) Field of Classification Search ..... 206/372–379, 206/477, 482, 486; 211/69, 70.6; 248/309.1, 248/311.2, 313, 316.1, 316.7
See application file for complete search history.

(56) References Cited

U.S. PATENT DOCUMENTS 3,154,281 A * 10/1964 Frank ..... 248/316.7
5,133,455 A * 7/1992 Chow ..... 206/378
5,271,520 A * 12/1993 McAfee ..... 206/373
6,083,579 A * 7/2000 Schurman ..... 206/373
6,209,827 B1 * 4/2001 Kawai ..... 248/73
6,474,481 B1 * 11/2002 Liu ..... 211/69
7,374,042 B2 * 5/2008 Liu ..... 206/372
7,424,958 B1 * 9/2008 Eley ..... 211/70.6
2005/0133394 A1 * 6/2005 Liu ..... 206/373

* cited by examiner

*Primary Examiner* — Luan K Bui

(57) ABSTRACT

A tool positioning pad includes a pad having a plurality of position holes and at least one block unit detachably connected to the position holes. The tool bits are positioned via the position holes and the handles are positioned via the block unit so that the tool positioning pad can position not only the tool bits but also the handles. Therefore, when the users need multiple handles, the users do not need to take an added bag inconveniently for receiving the handles.

4 Claims, 8 Drawing Sheets

TOOL POSITIONING PAD

BACKGROUND OF THE INVENTION

1. Field of the Invention

The present invention relates to a tool positioning pad, and more particularly to the tool positioning pad for positioning tool bits and handles.

2. Description of Related Art

The conventional tool positioning pad is disposed in the tool box and includes a plurality of position holes. Each position hole includes a position arm and a plurality of surfaces. A protrusion is formed at the end of the position arm for locking the tool bit. The plurality of surfaces fastens the tool bit stably. Therefore, the tool bit is vertically and stably positioned in the position hole, and the tool bit is locked by the protrusion for preventing the tool bit from dropping out form the tool box.

However, there is no position hole for positioning the handle in the tool box. When the users need to use two or more handles, the users often take a bag for receiving the handles. It is very inconvenient. Thus, the conventional tool positioning pad still needs to be improved.

The present invention has arisen to mitigate and/or obviate the disadvantages of the conventional. Further benefits and advantages of the present invention will become apparent after a careful reading of the detailed description with appropriate reference to the accompanying drawings.

SUMMARY OF THE INVENTION

The main objective of the present invention is to provide an improved tool positioning pad.

To achieve the objective, a tool positioning pad comprises a pad having a plurality of position holes disposed thereon, at least one block unit further comprising a base, a block part and a post, the block part formed at one side of the base and one end of the post formed at another side of the base, the post being inserted into the position hole, a lock plate being polygonal and formed at another end of the post, at least one first groove formed at the inside wall of the position hole and a lock ring corresponding to the first groove formed around the lateral surface of the post, at least one second groove formed on the bottom of the pad around the position hole and at least one protrusion corresponding to the second groove formed on the lock plate, the distance between the opposite of inside walls of the position hole decreasing gradually toward the bottom of the pad, the position hole and the lock plate both being rectangular, the protrusion formed on the corners of the lock plate, the second groove formed on the sides of the position hole under the pad;

wherein the post is inserted into the position hole and the base resists against the surface of the pad, thereafter the lock plate is engaged with the bottom of the of the pad under the position hole by rotating the block unit so as to position the block unit on the pad, therefore the position hole not only positions the tool bits but also positions the handle via the block unit.

Further benefits and advantages of the present invention will become apparent after a careful reading of the detailed description with appropriate reference to the accompanying drawings.

DETAILED DESCRIPTION OF THE INVENTION

Figure 1:
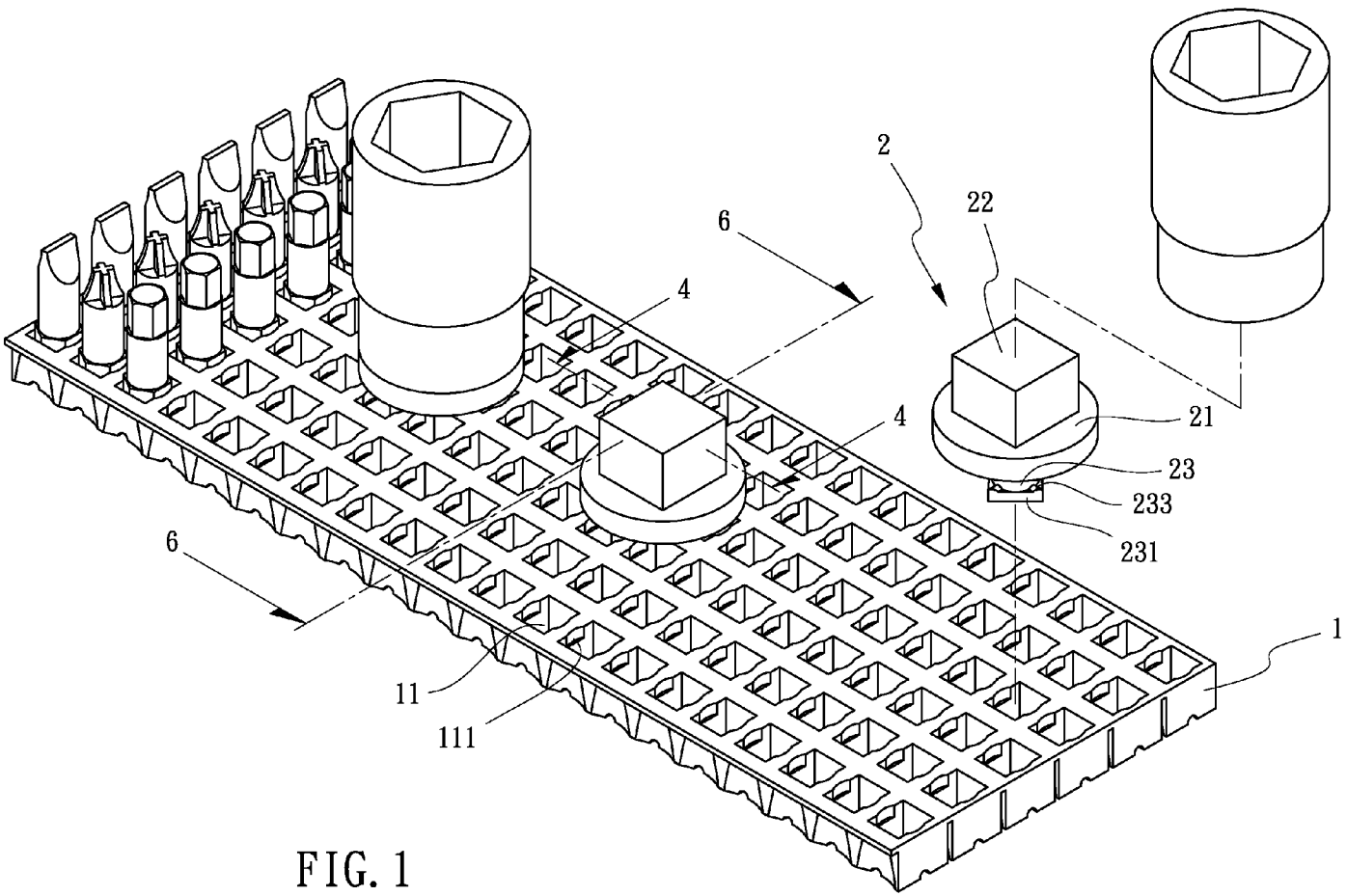
FIG. 1 is an exploded view of a tool positioning pad of the present invention.
Figure 2:
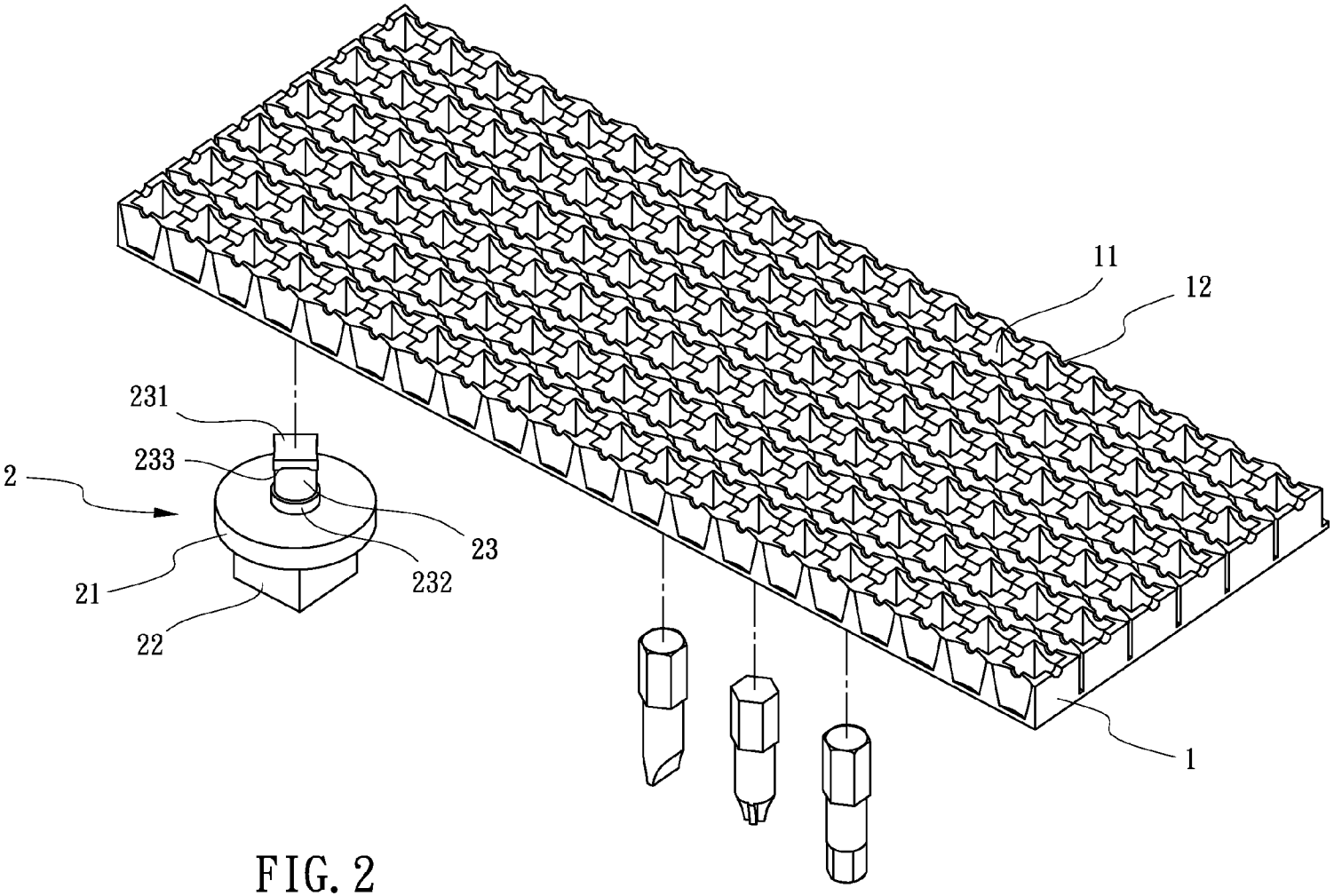
FIG. 2 is an upward exploded view of the tool positioning pad of the present invention.
Figure 3:
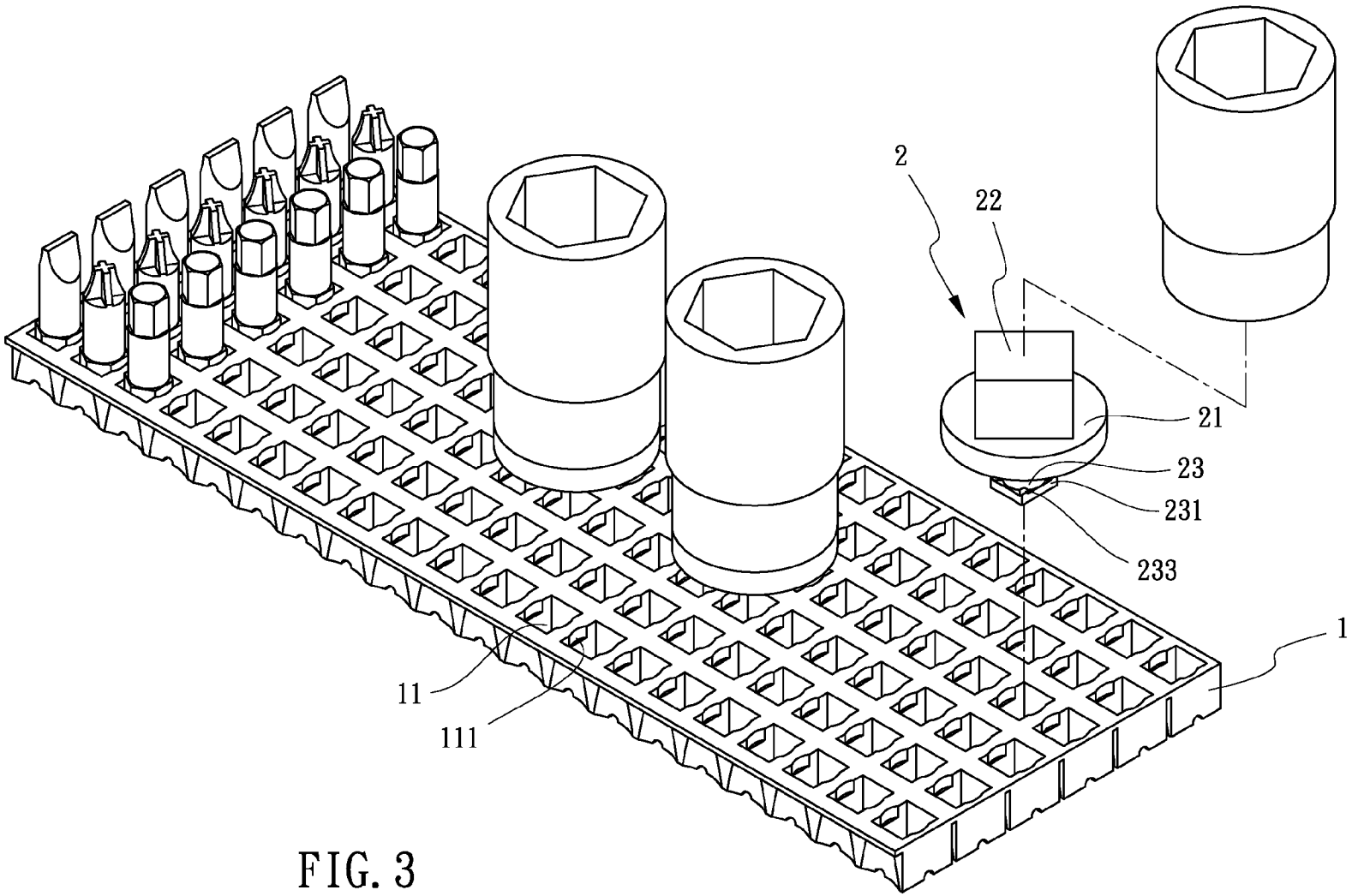
FIG. 3 is an assembled view for showing the handle positioned on the tool positioning pad by the present invention.
Figure 4:
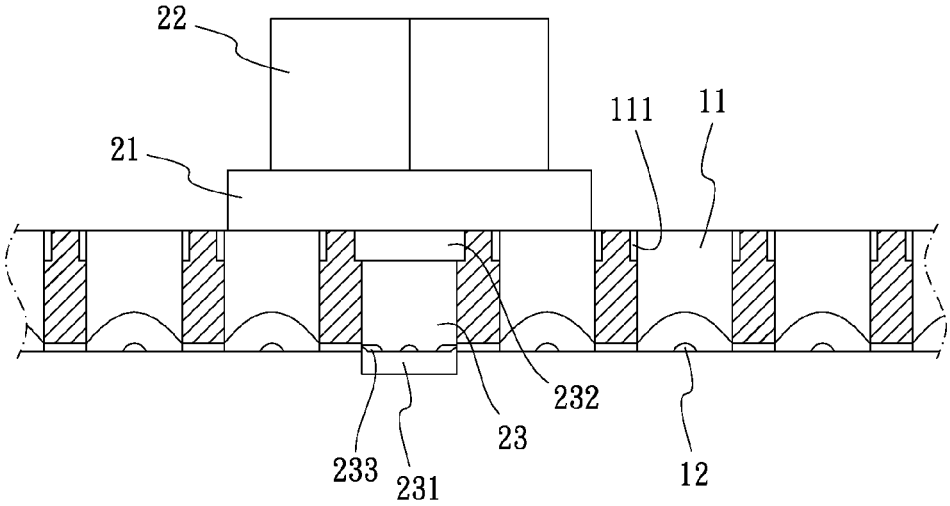
FIGS. 4-5 are the cross-sectional views of the tool positioning pad along a line 4-4 shown in FIG. 1 for showing a block unit being locked on the tool positioning pad of the present invention.
Figure 5:
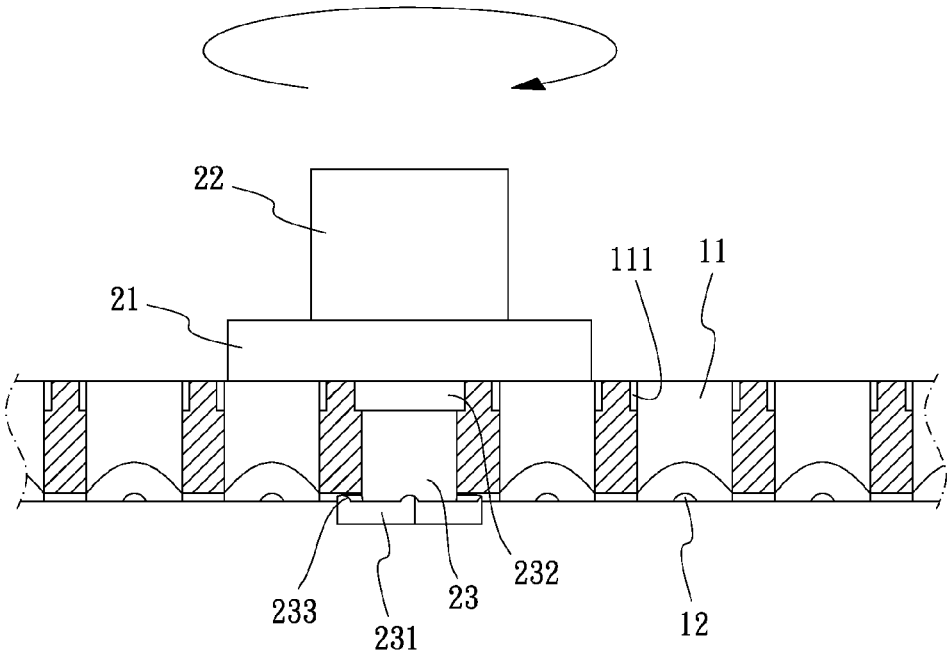
Figure 6:
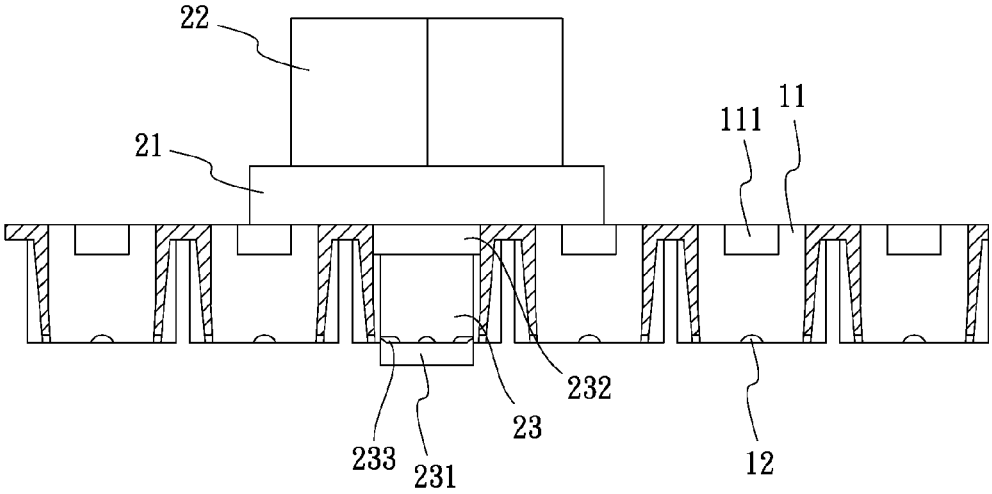
FIGS. 6-7 are the cross-sectional views of the tool positioning pad along a line 6-6 shown in FIG. 1 for showing the block unit being locked on the tool positioning pad of the present invention.
Figure 7:
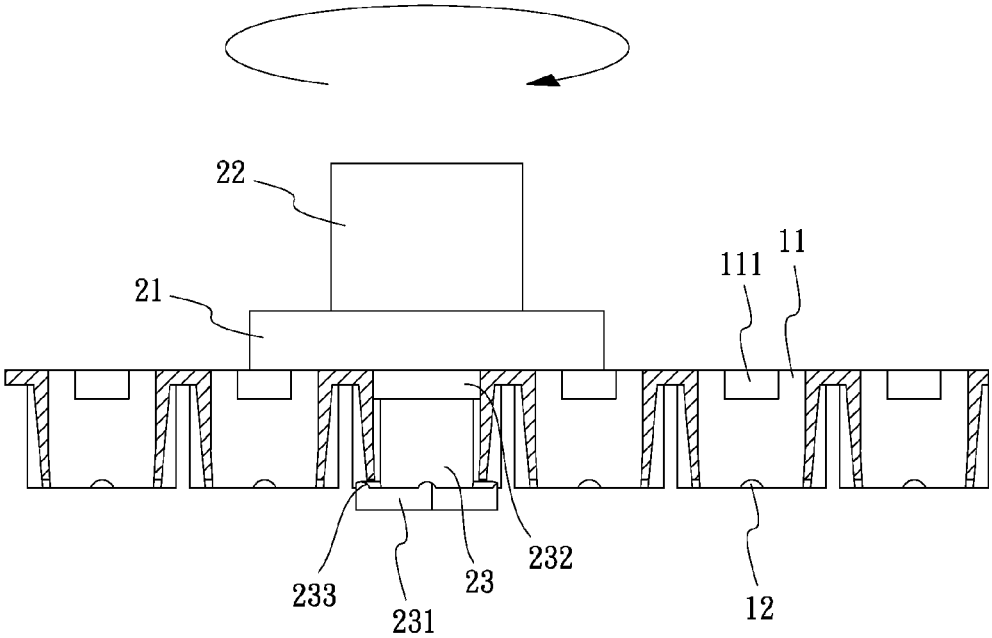

Referring to the drawings to FIGS. 1-2, a tool positioning pad in accordance with the present invention comprises a pad (1) and at least one block unit (2). A plurality of position holes (11) is disposed on the pad (1). The block unit (2) comprises a base (21), a block part (22) and a post (23). The block part (22) is formed at one side of the base (21). One end of the post (23) is formed at another side of the base (21). The post (23) passes through the position hole (11). A lock plate (231) is polygonal and is formed at another end of the post (23). The position hole (11) and the lock plate (231) are both rectangular in the embodiment (as shown in FIGS. 1-2) and the tool bit is positioned at the position hole (11). At least one first groove (111) is defined at the inside wall of the position hole (11). A lock ring (232) is corresponding to the first groove (111) and is formed around the lateral surface of the post (23). Two first grooves (111) are respectively formed at the two opposite of inside walls of the position hole (11) (as shown in FIGS. 1-2). The first groove (111) has one end for resisting against the lock ring (232) so that the block unit (2) is positioned at the site relative to the position hole (11). At least one second groove (12) is formed on the bottom of the pad (1) around the position hole (11). At least one protrusion (233) is corresponding to the second groove (12) and is formed on corners of the lock plate (231) (as shown in FIGS. 1-2). The distance between the opposite of inside walls of the position hole (11) decreases gradually toward the bottom of the pad (1) so as to clamp the tool bit or the block unit (2) firmly.

Referring to the drawings to FIGS. 3-7, the lock plate (231) of the block unit (2) passes through the position hole (11) and the post (23) is inserted into the position hole (11), so that the lock ring (232) resists against the end of the first groove (111) and the base (21) resists against the surface of the pad (1). Thereafter, the protrusion (233) is engaged with the second groove (12) by rotating the block unit (2) so as to position the block unit (2) stably in the position hole (11). Therefore, the handle is positioned on the pad (1) via the block part (22) so as to be carried conveniently.

Figure 8:
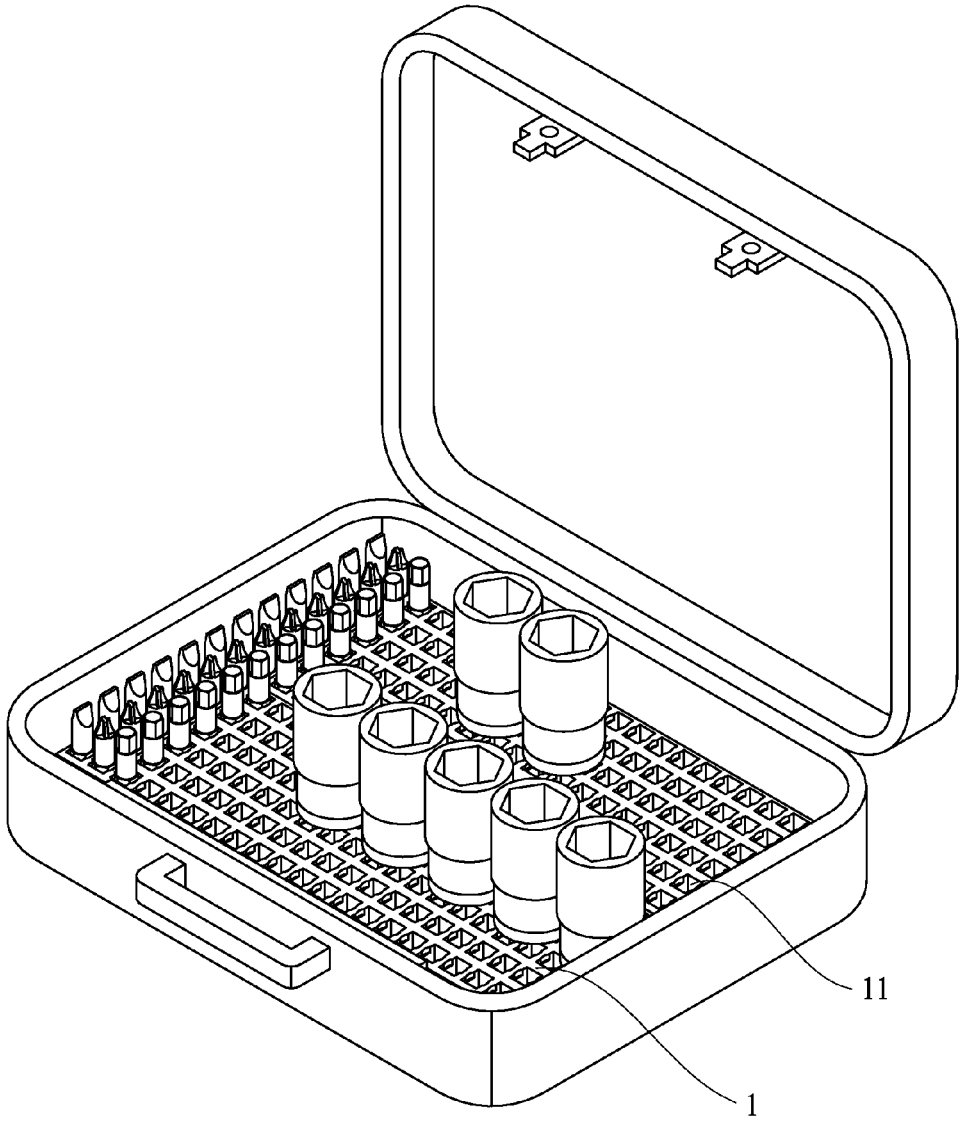
FIG. 8 is a perspective view for showing the embodiment for the tool box of the present invention.
Figure 9:
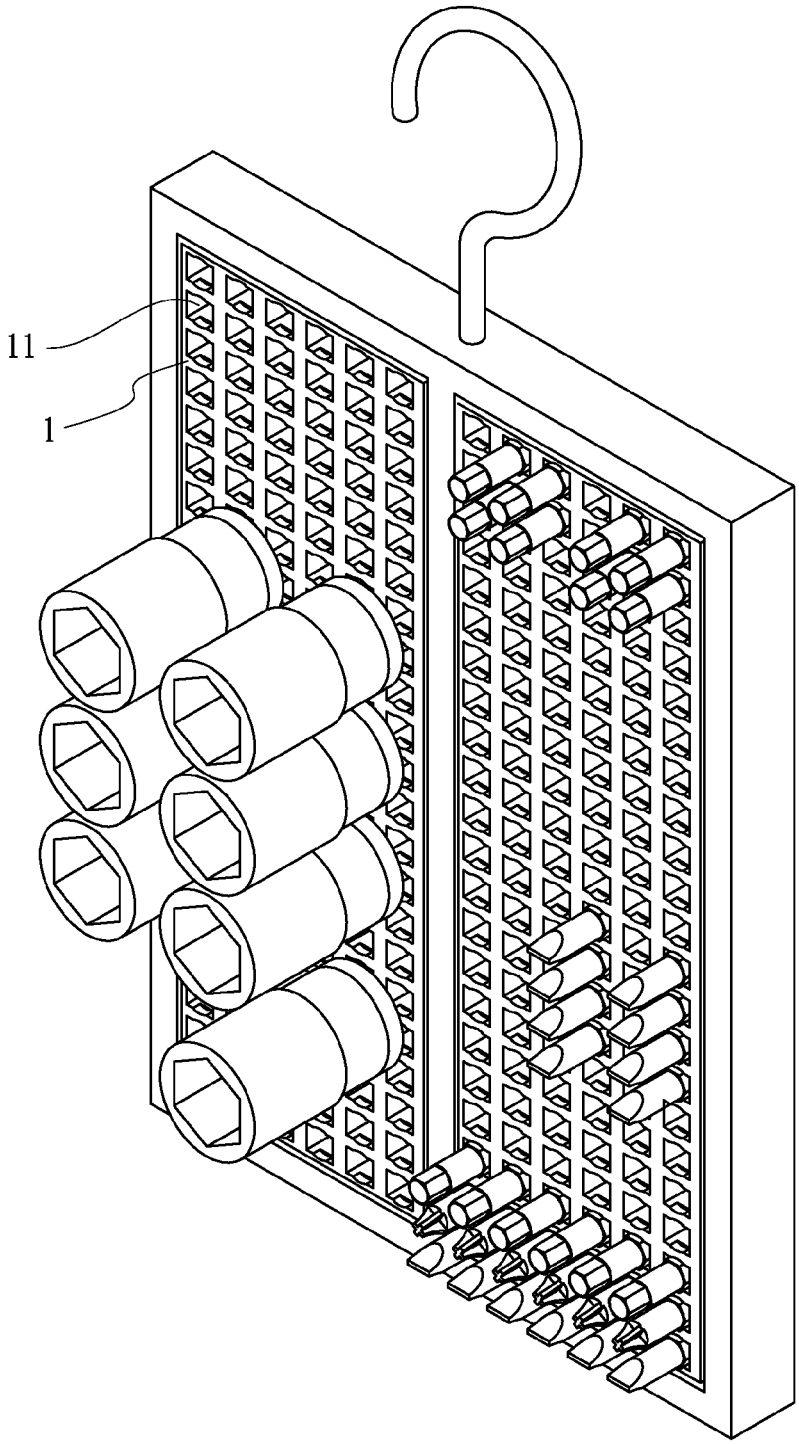
FIG. 9 is a perspective view for showing the embodiment for the tool positioning hanger of the present invention.
Figure 10:
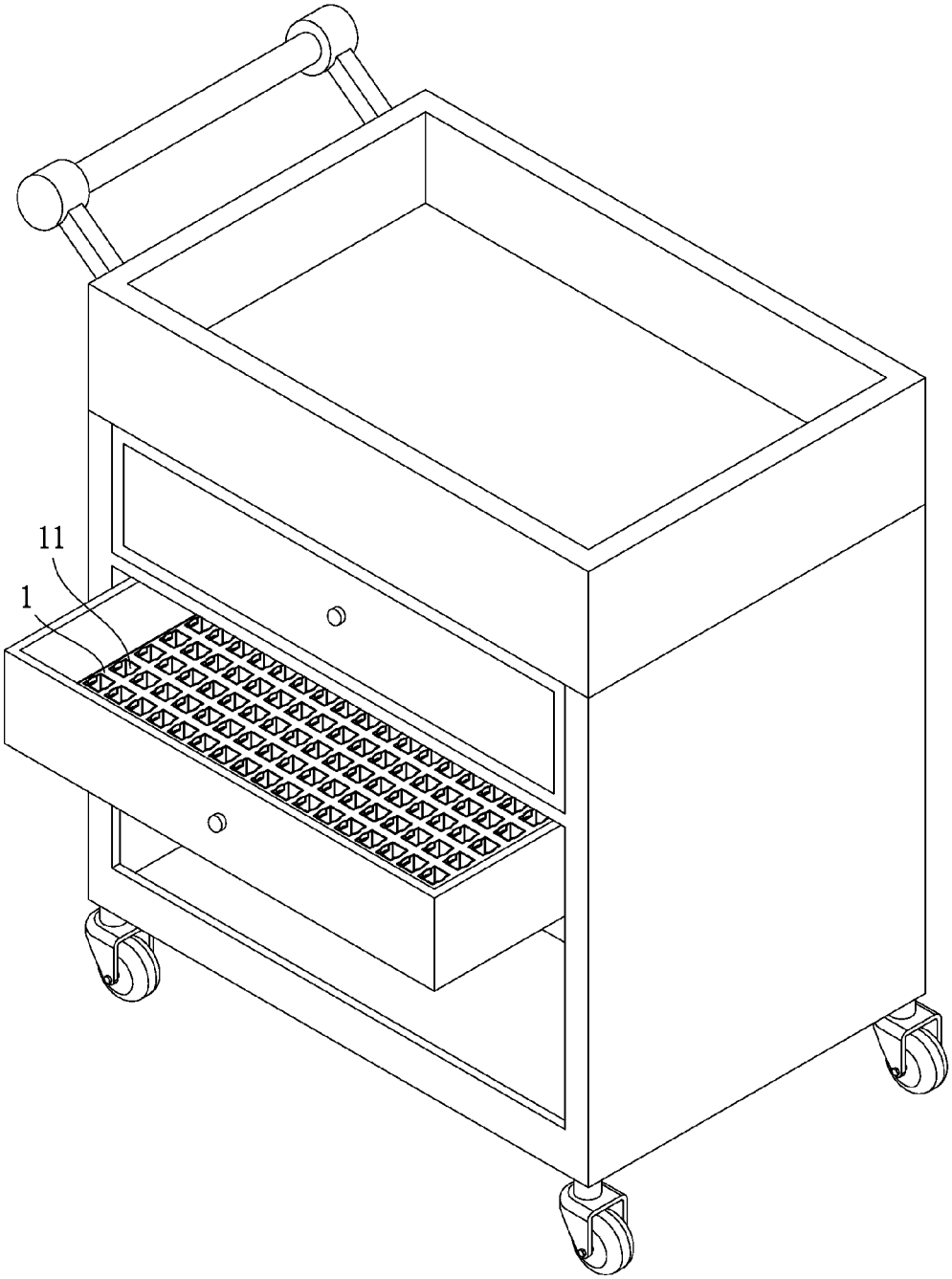
FIG. 10 is a perspective view for showing the embodiment for the tool cart of the present invention.

Referring to the drawings to FIGS. 8-10, the tool positioning pad is used for other embodiments, such as tool box, tool positioning hanger or tool cart.

Although the invention has been explained in relation to its preferred embodiment, it is to be understood that many other possible modifications and variations can be made without departing from the spirit and scope of the invention as hereinafter claimed.

What is claimed is:

1. A tool positioning pad comprising:

a pad having a plurality of position holes disposed thereon;

at least one block unit further comprising a base, a block part and a post, the block part formed at one side of the base and one end of the post formed at another side of the base, the post being inserted into a position hole, a lock plate being polygonal and formed at another end of the post; and at least one first groove being formed at an inside wall of the position hole and a lock ring corresponding to the first groove being formed around a lateral surface of the post;

wherein the post is inserted into the position hole and the base resists against the surface of the pad, thereafter the lock plate is engaged with the bottom of the pad under the position hole by rotating the block unit so as to position the block unit on the pad.

2. The tool positioning pad as claimed in claim 1, wherein at least one second groove is formed on the bottom of the pad around the position hole and at least one protrusion corresponding to the second groove is formed on the lock plate.

3. The tool positioning pad as claimed in claim 1, wherein the distance between the opposite of inside walls of the position hole decreases gradually toward the bottom of the pad.

4. The tool positioning pad as claimed in claim 2, wherein the position hole and the lock plate are both rectangular; the protrusion is formed on the corners of the lock plate; the at least one second groove is formed on the sides of the position hole under the pad.

* * * * *